US008251269B2

(12) United States Patent
Winneur

(10) Patent No.: US 8,251,269 B2
(45) Date of Patent: Aug. 28, 2012

(54) CARRYING DEVICE

(76) Inventor: Richard C. Winneur, Brighton, MI (US)

( * ) Notice: Subject to any disclaimer, the term of this patent is extended or adjusted under 35 U.S.C. 154(b) by 640 days.

(21) Appl. No.: 12/394,562

(22) Filed: Feb. 27, 2009

(65) Prior Publication Data

US 2010/0219222 A1 Sep. 2, 2010

(51) Int. Cl.
*A45F 3/00* (2006.01)

(52) U.S. Cl. ..... 224/629; 224/650; 224/645; 224/652

(58) Field of Classification Search ..... 224/645, 224/629, 650, 652, 576
See application file for complete search history.

(56) References Cited

U.S. PATENT DOCUMENTS

| | | | | | |
|---|---|---|---|---|---|
| 3,572,560 | A * | 3/1971 | Dolph | 224/612 |
| 3,997,092 | A * | 12/1976 | Pogwizd | 224/610 |
| 4,088,250 | A * | 5/1978 | Schaefer | 224/235 |
| 4,193,525 | A * | 3/1980 | Sommers | 224/414 |
| 4,197,890 | A * | 4/1980 | Simko | 383/97 |
| 4,228,908 | A * | 10/1980 | Tweeton | 215/11.6 |
| 4,401,245 | A * | 8/1983 | Zills | 224/148.3 |
| 4,796,789 | A * | 1/1989 | Willcocks | 224/581 |
| 4,852,896 | A * | 8/1989 | Mills | 280/47.18 |
| 4,911,347 | A * | 3/1990 | Wilhite | 224/257 |
| 5,318,821 | A | 6/1994 | Bradley, Jr. | |
| 5,429,265 | A * | 7/1995 | Maire et al. | 220/522 |
| 5,562,229 | A * | 10/1996 | Callahan | 220/694 |
| 5,595,429 | A * | 1/1997 | Kennedy | 312/235.2 |
| 5,609,265 | A | 3/1997 | Haberkorn et al. | |
| 6,024,265 | A * | 2/2000 | Clements | 224/630 |
| 6,029,877 | A * | 2/2000 | Woods | 224/652 |
| 6,161,738 | A | 12/2000 | Norris | |
| 6,422,444 | B1 * | 7/2002 | Richardson | 224/645 |
| 6,938,761 | B2 | 9/2005 | Nish | |
| 7,153,025 | B1 * | 12/2006 | Jackson et al. | 383/2 |
| 7,832,663 | B1 * | 11/2010 | Cotham | 239/653 |
| 2006/0151561 | A1 * | 7/2006 | Quinn | 224/652 |
| 2007/0205234 | A1 | 9/2007 | Lessmann | |
| 2007/0267454 | A1 * | 11/2007 | Baiz | 224/901.8 |

* cited by examiner

*Primary Examiner* — Brian D Nash
(74) *Attorney, Agent, or Firm* — Gifford, Krass, Sprinkle, Anderson & Citkowski, P.C.

(57) ABSTRACT

In one aspect, there is disclosed a carrying device that comprises in combination a bucket and a cover positioned about the bucket. The cover may include a cylindrical wall, an open top, and a bottom wall. The bottom wall includes an opening covered by a moveable barrier for allowing access to the bucket from a bottom of the cover. The cylindrical wall may include a zipper secured thereon. The zipper allows the cylindrical cover to open for positioning the bucket in and out of the cover. The bucket may further include a lid that is removably attached to the bucket. A padded cover may be positioned on the lid providing a seating surface.

17 Claims, 6 Drawing Sheets

CARRYING DEVICE

FIELD OF THE INVENTION

The invention relates to carrying devices, and with more particularity to carrying devices including a bucket and cover,

BACKGROUND OF THE INVENTION

Carrying devices are generally known in the art and include various types of satchels, backpacks or other carrying devices. For example, U.S. Pat. No. 6,938,761 discloses a sportsman's utility bucket cover apparatus and method in which a utility bucket is positioned within a cover. The bottom surface of the cover includes a padding that is aligned with a bottom of the bucket such that a bucket may be turned upside down with the open end positioned on the ground with a user seated on the closed end of the bucket on the padded seat. However, in order to allow a user to be seated on such a device the bucket must be emptied of its contents as specified in the patent. Additionally, as the seat padding is positioned on a bottom of the bucket, one cannot gain access to an interior of a bucket positioned within the backpack from a bottom wall of the cover. Further, as the bucket and cover do not include a top or lid when positioned on a back of a user, various contents of the bucket may be prone to spillage or falling out of the bucket when carried by a user.

There is therefore a need in the art for an improved carrying device that eliminates the problems outlined above with respect to the prior art.

SUMMARY OF THE INVENTION

In one aspect, there is disclosed a carrying device that comprises in combination a bucket and a cover positioned about the bucket. The cover may include a cylindrical wall, an open top, and a bottom wall In one aspect, the bottom wall includes an opening covered by a moveable barrier for allowing access to the bucket from a bottom of the cover.

In another aspect, there is disclosed a carrying device that includes in combination a bucket and a cover positioned about the bucket. The cover may include a cylindrical wall, an open top and a bottom wall. The cylindrical wall may include a zipper secured thereon. The zipper allows the cylindrical cover to open for positioning the bucket in and out of the cover.

In a further aspect, there is disclosed a carrying device that comprises in combination a bucket and a cover positioned about the bucket. A lid is removeably attached to a top of the bucket. The cover may include a cylindrical wall, an open top and a bottom wall. A padded cover is positioned on the lid for providing a seating surface.

DETAILED DESCRIPTION OF THE PREFERRED EMBODIMENTS

Figure 1:
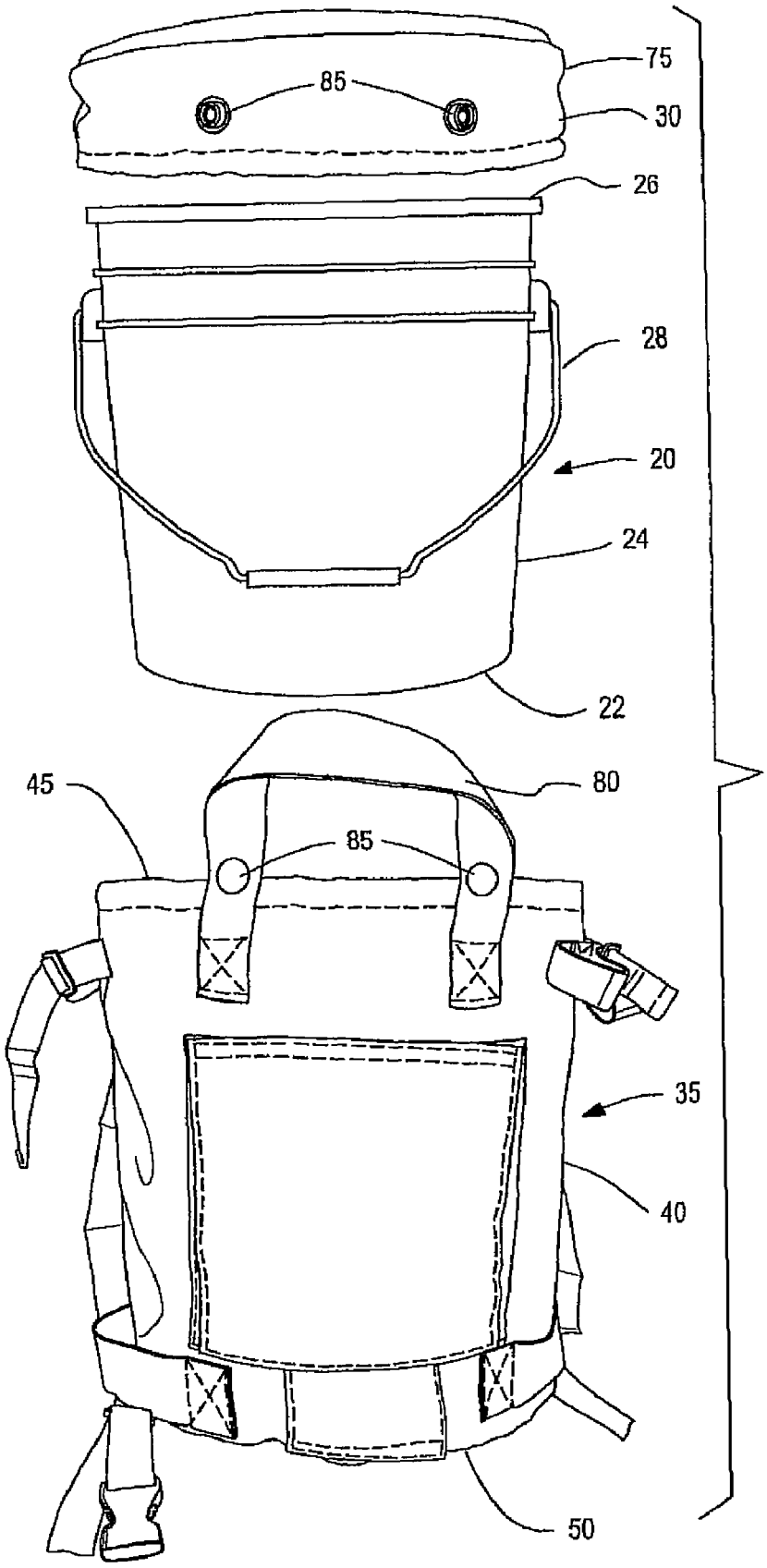
FIG. 1 is an exploded perspective view of a cover, bucket and padded cover.
Figure 2:
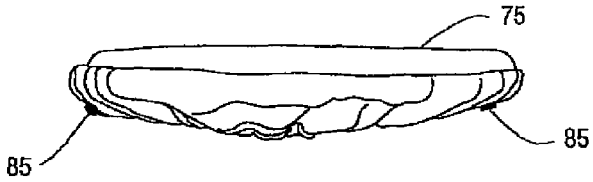
FIG. 2 is a side view of a padded cover.
Figure 3:
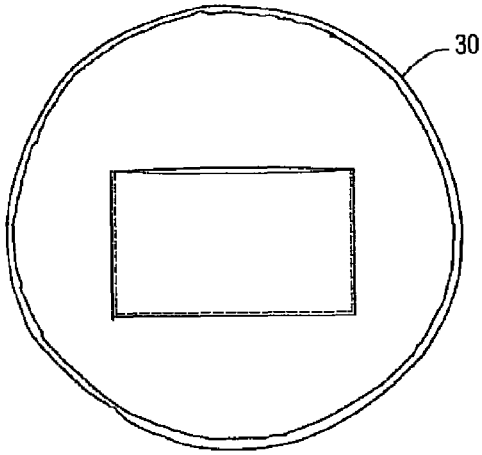
FIG. 3 is a top view of a lid for a bucket.

Referring to FIGS. 1-10, there is shown a first embodiment of a carrying device 15. The carrying device 15 may include a bucket 20. The bucket 20 may be of varying sizes such as a five gallon utility bucket The bucket 20 generally includes a bottom wall 22, a cylindrical wall 24 extending from the bottom wall 22 and an open top 26. A carrying handle 28 may be attached to the cylindrical wall 24. The bucket 20 may also include a lid 30 as shown in FIGS. 1 and 3 that is attached to a top of the bucket 20 to close off the open top 24. The lid may include pockets thereon.

Figure 9:
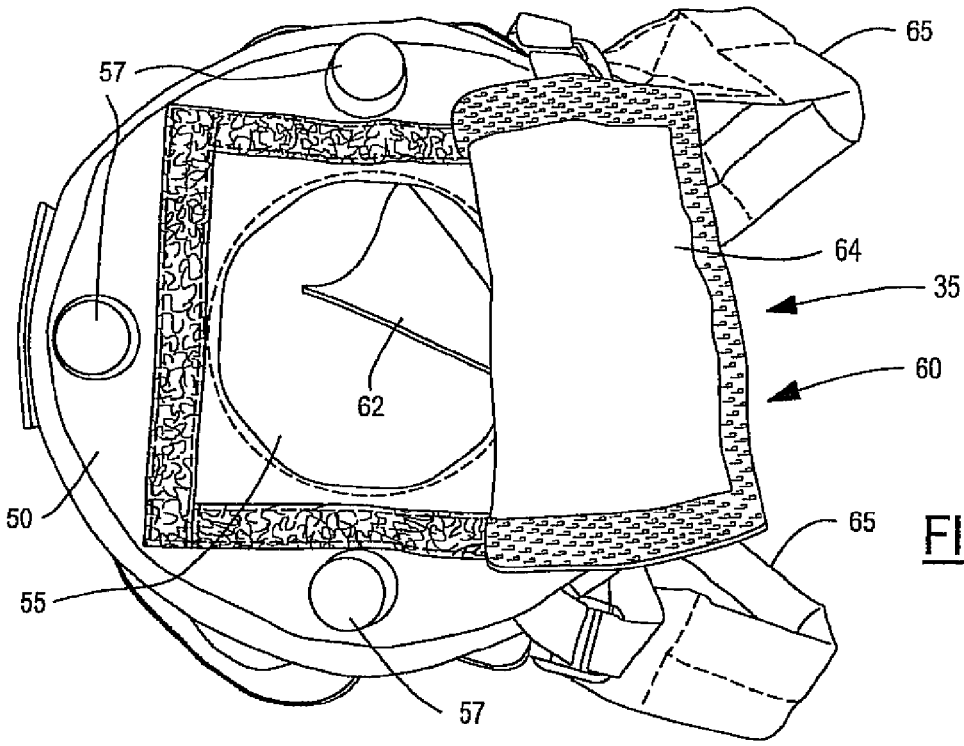
FIG. 9 is a bottom view of the cover detailing the moveable barrier in an open position.

The carrying device 15 may also include a cover 35 that is positioned about the bucket 20. The cover 35 may include a cylindrical wall 40, an open top 45 and a bottom wall 50. In one aspect, the bottom wall 50 may include an opening 55 covered by a moveable barrier 60 for allowing access to the bucket 20 from a bottom of the cover 35, as shown in FIG. 9. The bottom wall 50 of the cover 35 may also include support feet 57 for positioning the carrying device 15 above the ground when the carrying device 15 is utilized as a seat. In this manner, abrasion relative to the bottom wall 50 of the cover 35 as well as providing a secure contact of the carrying device 15 with the ground is provided.

In one aspect, the bottom wall 22 of the bucket 20 as described above may include an opening or hole formed therein such that it is accessible from a bottom of the cover 35. In this manner, the contents of the interior of the bucket 20 may be accessed while the carrying device 15 is positioned on a back of a user, as will be described in more detail below.

Figure 10:
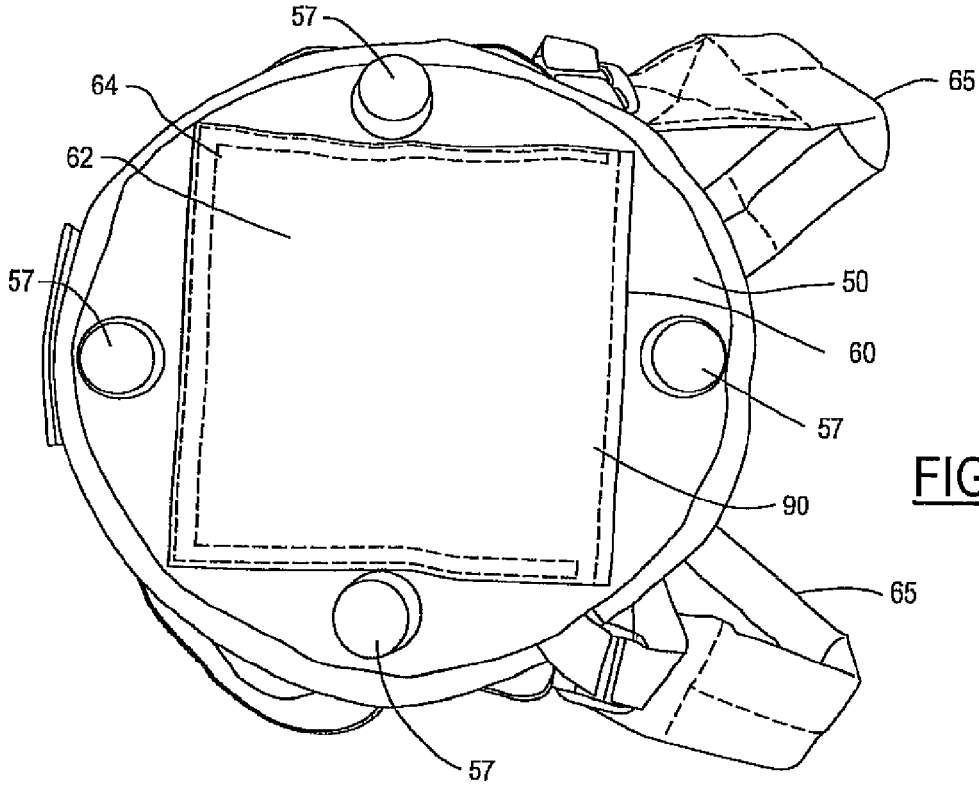
FIG. 10 is a bottom view of the cover with the moveable barrier in the closed position.
Figure 11:
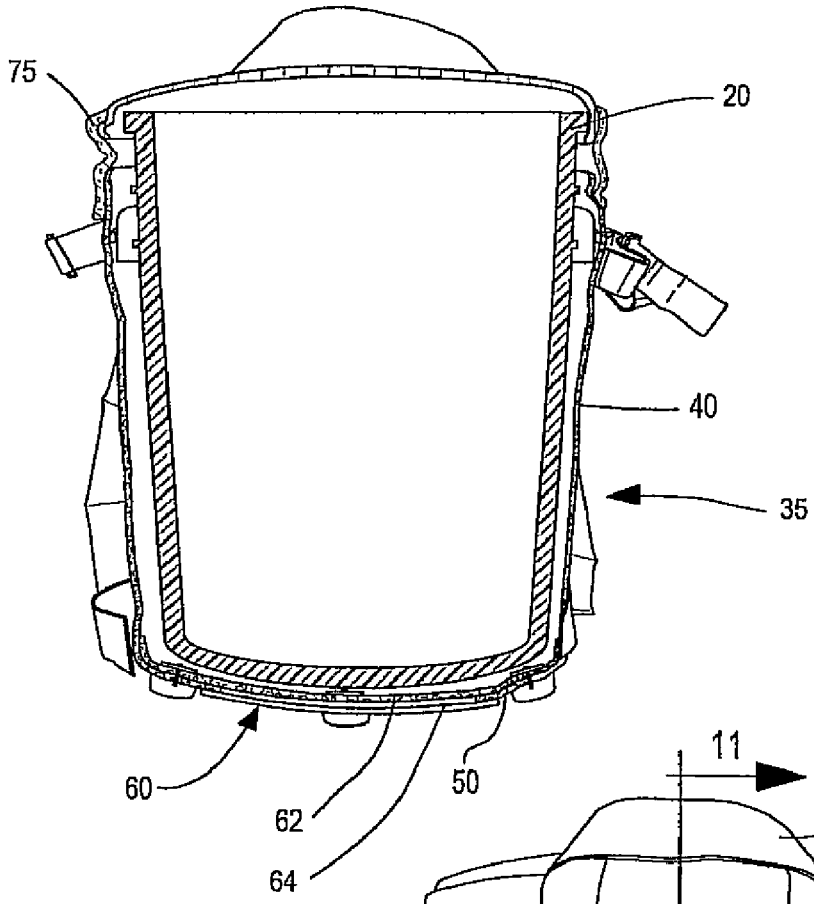
FIG. 11 is a sectional view of a cover and bucket.

In one aspect and as best seen in FIGS. 9 and 10, the moveable barrier 60 may include a first flap 62 that is pivotally attached to the bottom wall 50 of the cover 35. A second flap 64 may also be pivotally attached to the bottom wall 50 of the cover 35 such that it pivots in an opposite direction relative to the first flap 62. The second flap 64 may be releasably attached to the bottom wall 50 of the cover 35. In this manner, the moveable barrier 60 provides for a two-stage release of the barrier to securely retain contents within the cover 35. In one aspect the second flap 64 may be secured to the bottom wall 50 using various fasteners such as snaps, Velcro, or other attachment mechanisms.

Figure 7:
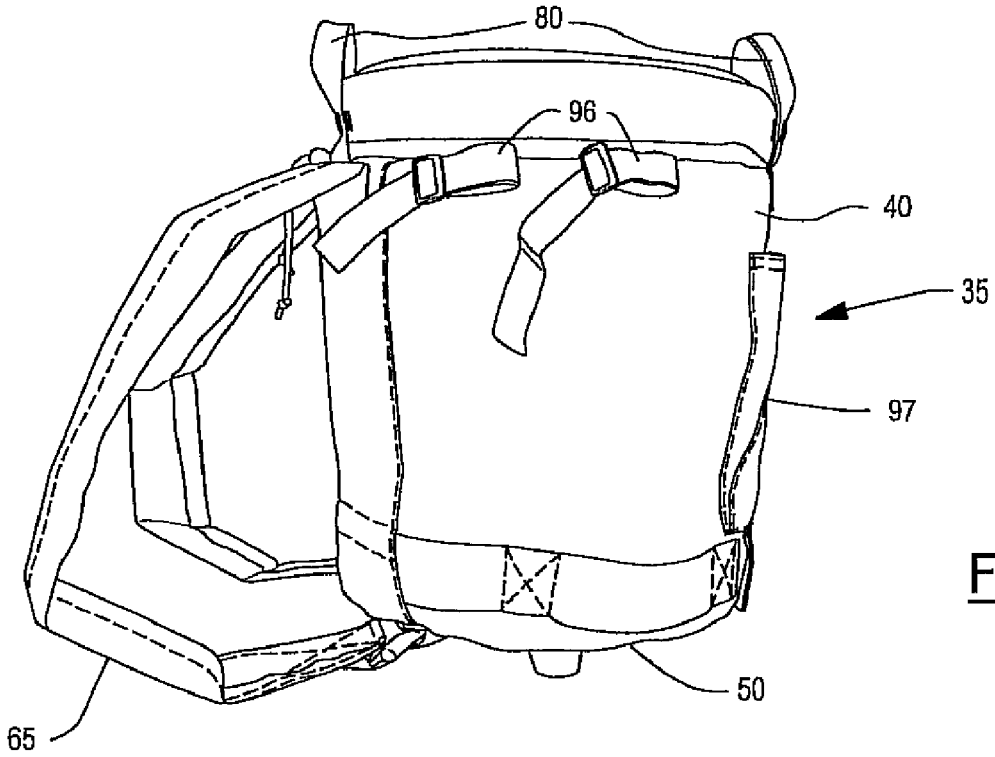
FIG. 7 is a side view of the cover detailing the carrying straps and retaining structures.
Figure 8:
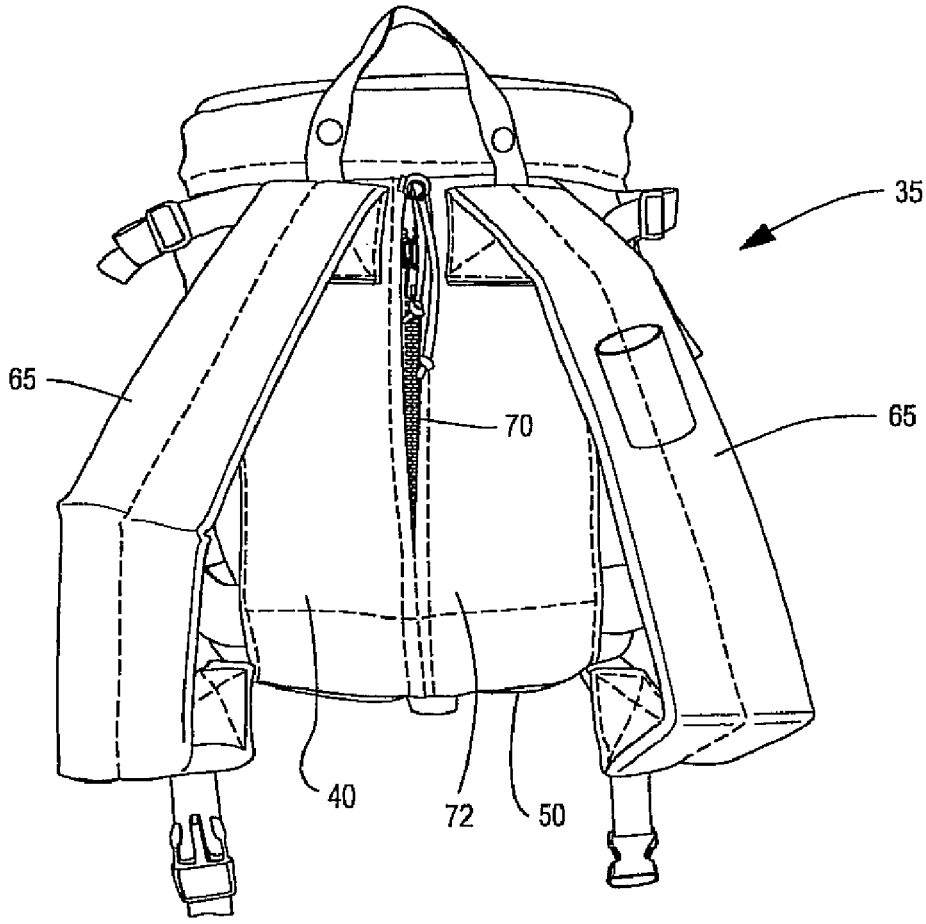
FIG. 8 is a back view of the cover detailing the carrying straps and zipper attached to the cylindrical wall of the cover.

Referring to FIGS. 7 and 8, the cylindrical wall 40 of the cover 35 may include straps 65 attached thereon for supporting the carrying device 15 on a back of a user. The straps 65 may include common backpack type straps with padding formed on the straps as well as a center strap to securely retain the carrying device 15 on the back of a user. Additionally the straps may include pockets.

Referring to FIG. 8, in one aspect the cylindrical wall 40 of the cover 35 may include a zipper 70 secured thereon. The zipper 70 allows the cover 35 to open for positioning the bucket 20 in and out of the cover 35. As shown in the depicted embodiment of FIG. 8, the zipper 70 may be positioned on the cylindrical wall 40 between the straps 65. In another aspect, padding 72 may be attached to the cylindrical wall 40 on a portion of the cylindrical wall 40 proximate the straps 65. In this manner, the padding 72 may be positioned against the back of a user providing comfort and isolation of the carrying device 15 relative to the back of a user.

Figure 4:
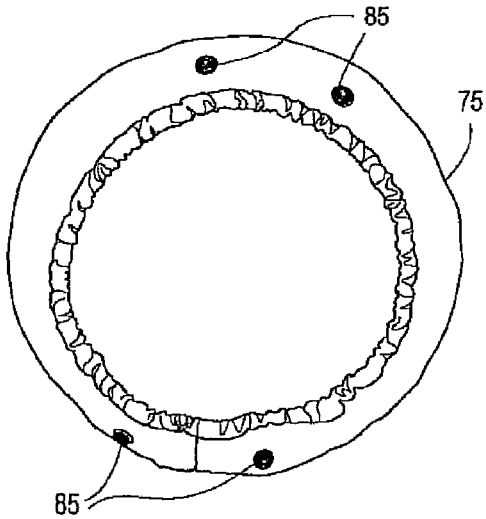
FIG. 4 is a bottom view of a padded cover.

As stated above, the bucket 20 may include a lid 30 that is removably attached to the bucket 20. The lid 30 also may include a padded cover 75 positioned thereon for cushioning a seated user, as best seen in FIGS. 2-4. In one aspect, the cover 35 may include handles 80 secured to an upper portion of the cylindrical wall 40. The handles 80 may include an attachment 85 linking with a corresponding attachment 85 on the padded cover 75 for securing the lid 30 and padded cover 75 to the cylindrical wall 40 of the cover 35. In this manner, one of the handles 80 may act as a pivot such that the lid 30 may be pried off the bucket 20 and then flipped over and retained by one of the attachments 85 on the handle 80 that is attached to the padded cover 75.

Figure 5:
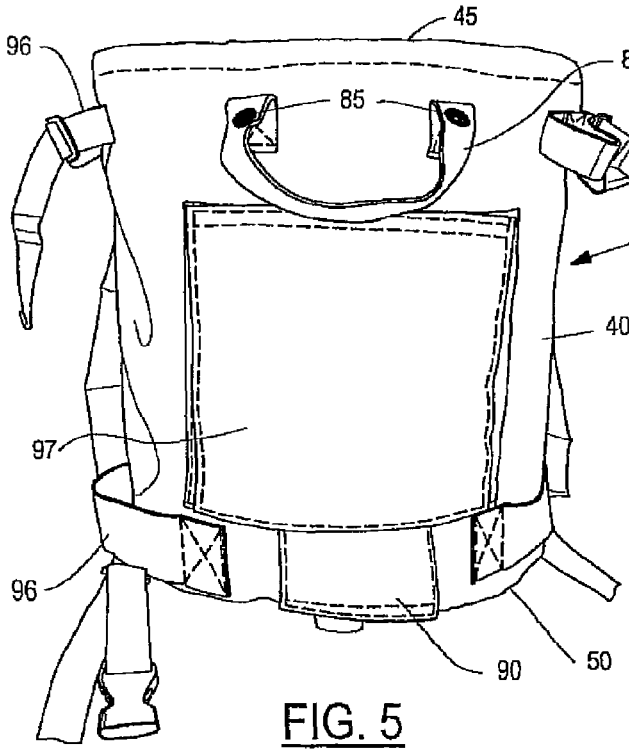
FIG. 5 is a side view of a cover including a pocket, handle and flap positioned on a bottom edge of the cover.
Figure 6:
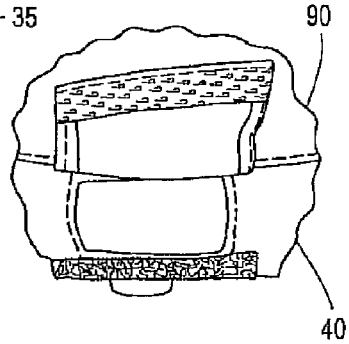
FIG. 6 is a blown up view of the flap opened along the bottom edge of the cover.

Referring to FIGS. 5 and 6, there is shown the cylindrical wall 40 of the cover 35. As can be seen in FIG. 5, the lower edge of the cylindrical wall 40 may include a flap 90 that is pivotally secured thereon for allowing access to a drain or tap of the bucket 20. As can be seen in FIG. 6, the flap 90 may be pivotally moved relative to the cylindrical wall 40 allowing entrance into the inside of the cover 35. In such a manner, a bucket 20 including a tap or other drain type device may be positioned within the cover 35 allowing the drain access to an outside environment.

Figure 12:
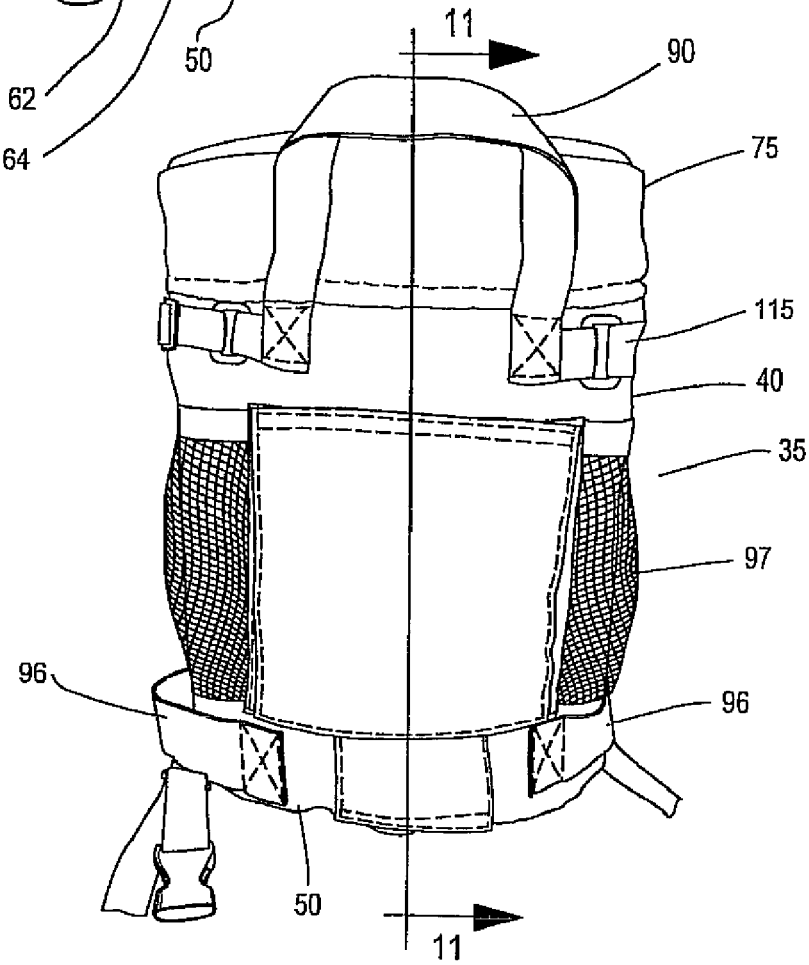
FIG. 12 is a side view of an alternate embodiment of a cover detailing the cinching strap attached to the cylindrical wall of the cover and detailing a zippered mesh pocket.
Figure 13:
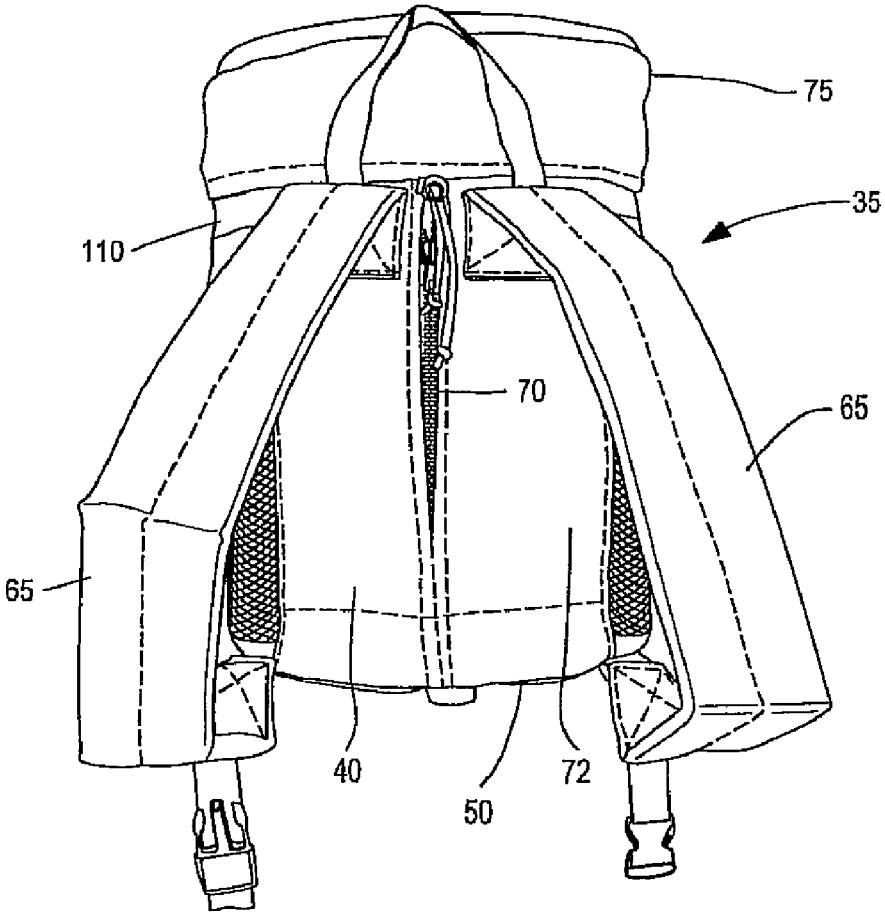
FIG. 13 is a back view of the cover including the zipper of an alternate embodiment.
Figure 14:
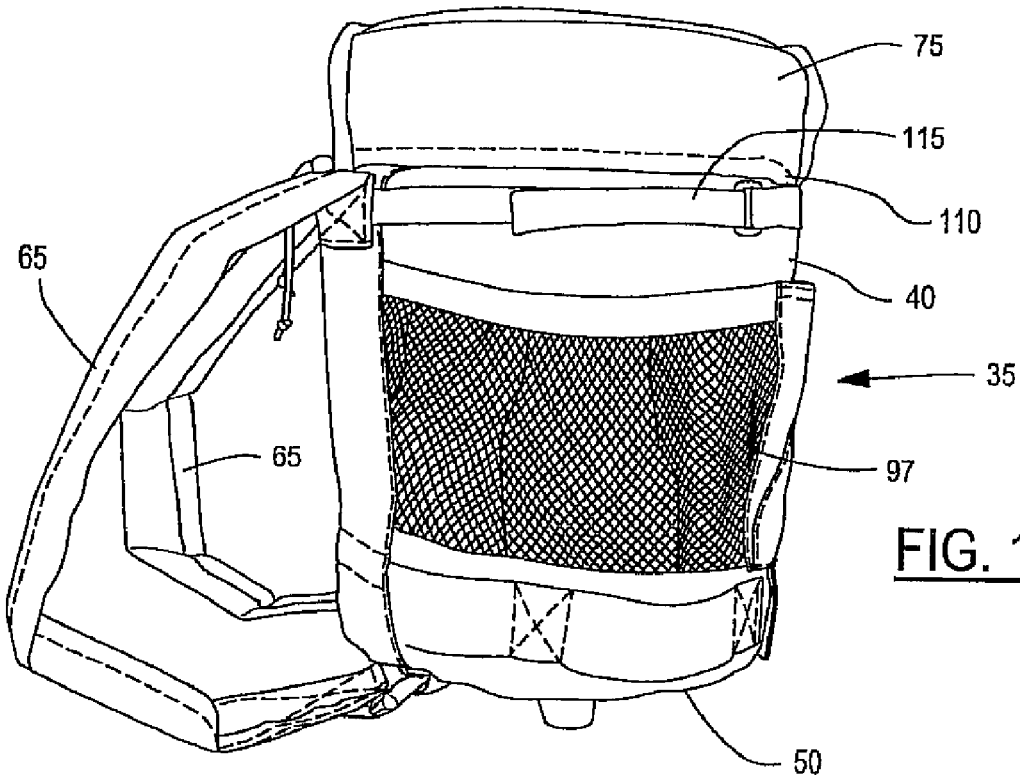
FIG. 14 is a side view of the alternate embodiment of FIG. 12 detailing the zipper pocket, carrying straps and cinch strap.

Referring to FIGS. 1-10, various retaining structures 95 may be attached to an outside of the cylindrical wall 40. Various type retaining structures 95 may be included and include straps 96 and pockets 97 with or without closures. The straps 96 may be configured such that they include cinching buckles such that they may be adjusted to accommodate various size accessories. Additionally, bungee type straps or other types of straps may additionally be applied to an outside of the cylindrical wall 40 for retaining various accessories on an outside of the carrying device 15. Additionally, as shown in FIGS. 5 and 12, pockets 97 including an open top and closures may be positioned on an outside of the cylindrical wall 40.

In one aspect, and as best shown in FIGS. 1 and 5, the top portion of the cylindrical wall 40 may include a pocket 100 that receives a drawstring 105 for tightening the cover 35 about a top portion of the bucket 20. In this manner, the drawstring 105 may be utilized to position the bucket 20 relative to the cover 35 such that it does not easily slide out of the cover 35.

In an alternate design as shown in FIGS. 11-14, the padded cover 75 on the lid 30 may include a portion 110 that extends down about the cylindrical wall 40 of the cover 35. In this embodiment, a draw strap 115 may be attached to a top portion of the cylindrical wall 40 for tightening about the portion 110 of the padded cover 75 that extends about the cylindrical wall 40. Additionally, the second embodiment may include similar structures described above relative to the first embodiment including the zipper 70 attached to the cylindrical wall 40 as well as the carrying straps 65 and other structures described above. In one aspect, the second embodiment may include mesh type pockets 97 attached to an outside of the cylindrical wall 40. Various accessories may be positioned in the mesh pockets 97 and can be easily seen by a user.

In use, a user may position a bucket 20 within the cover 35 by unzipping the zipper 70 attached to the cylindrical wall 40. Once the bucket 20 has been positioned within the cover 35 the zipper 70 may be drawn upwards such that the cover 35 is positioned around the cylindrical wall 24 of the bucket 20. Next the drawstring 105 may be cinched in the first embodiment such that a top portion of the cover 35 is securely attached to the bucket 20. A lid 30 may be secured to the top of the bucket 20 with the padded cover 75 positioned about the lid 30. In this manner, the lid 30 may be inserted around a draw or elastic of the padded cover 75 such that the padded portion is maintained on a top surface of the lid 30. The lid 30 may be fastened to the bucket 20 with the padded cover 75 being attached to the handles 80 on the cylindrical wall 40 of the cover 35 such that the padded cover 75 and lid 30 are securely retained relative to the cover 35. Various accessories may be stowed on an outside in the various pockets 97, straps 96 or other retaining structures 95. One may access various contents of the bucket 20 either through the moveable barrier 60 on the bottom wall 50 or by removing the lid 30 from the top of the bucket 20. Additionally, one may access a tap or drain of a bucket 20 positioned within the cover 35 through the flap 90 formed on the bottom portion of the cylindrical wall 40. A user may carry the carrying device 15 on his back utilizing the straps 65. Once a user has reached a specified location, the user may remove the straps 65 and position the carrying device 15 on the ground such that the support feet 57 formed on the bottom wall 50 position the carrying device 15 above a surface of the ground. A user may then be seated on the padded cover 75 positioned on the lid 30 that is attached to the top of the bucket 20.

The invention claimed is:

1. A carrying device comprising in combination: a bucket; and a cover positioned about the bucket, the cover including a cylindrical wall, an open top and a bottom wall wherein the bottom wall includes an opening covered by a moveable barrier for allowing access to the bucket from a bottom of the cover wherein a top portion of the cylindrical wall includes a pocket receiving a drawstring for tightening the cover about a top portion of the bucket.

2. The carrying device of claim 1 wherein the moveable barrier includes a first flap pivotally attached to the bottom wall and a second flap pivotally attached to the bottom wall in an opposite direction relative to the first flap, the second flap releasably attached to the bottom wall.

3. The carrying device of claim 1 wherein the cylindrical wall includes a zipper secured thereon, the zipper allowing the cylindrical cover to open for positioning the bucket in and out of the cover.

4. The carrying device of claim 1 wherein the bottom wall includes support feet for positioning the carrying device above the ground.

5. The carrying device of claim 1 including straps attached to the cylindrical wall for supporting the carrying device on the back of a user.

6. The carrying device of claim 1 including padding attached to the cylindrical wall on a portion of the cylindrical wall proximate straps.

7. The carrying device of claim 1 including a lid removably attached to the bucket, the lid including a padded cover positioned thereon for cushioning a seated user.

8. The carrying device of claim 7 including handles secured to an upper portion of the cylindrical wall, the handles including an attachment linking with a corresponding attachment on the padded cover for securing the lid to the cover.

9. The carrying device of claim 7 including a draw strap attached to a top portion of the cylindrical wall for tightening about the padded cover securing the padded cover relative to the cylindrical wall.

10. The carrying device of claim 1 including a flap pivotally secured along a lower edge of the cylindrical wall for allowing access to a drain of the bucket.

11. The carrying device of claim 1 including retaining structures attached to an outside of the cylindrical wall.

12. The carrying device of claim 11 wherein the retaining structures include straps, pockets, and zippered pockets.

13. A carrying device comprising in combination: a bucket; and a cover positioned about the bucket, the cover including a cylindrical wall, an open top and a bottom wall wherein the bottom wall includes an opening covered by a moveable barrier and wherein the cylindrical wall includes a zipper secured longitudinally thereon, the zipper allowing the cylindrical cover to open for positioning the bucket in and out of the cover.

14. A carrying device comprising in combination:

a bucket;

a lid removably attached to a top of the bucket;

a cover positioned about the bucket, the cover including a cylindrical wall, an open top and a bottom wall, the bottom wall includes an opening covered by a moveable barrier, the movable barrier attached to the bottom wall of the cover for allowing access to the bucket from a bottom of the cover; and a padded cover positioned on the lid for providing a seating surface.

15. The carrying device of claim 14 wherein the moveable barrier includes a first flap pivotally attached to the bottom wall and a second flap pivotally attached to the bottom wall in an opposite direction relative to the first flap, the second flap releasably attached to the bottom wall.

16. The carrying device of claim 14 wherein the cylindrical wall includes a zipper secured thereon, the zipper allowing the cylindrical cover to open for positioning the bucket in and out of the cover.

17. The carrying device of claim 14 wherein the bottom wall includes support feet for positioning the carrying device above the ground.

* * * * *